US006012532A

United States Patent [19]

Kiefer et al.

[11] Patent Number: 6,012,532

[45] Date of Patent: Jan. 11, 2000

[54] METHOD AND APPARATUS FOR PREVENTION, SUPPRESSION OR MITIGATION OF EXPLOSIONS IN CONFINED SUBTERRANEAN CHAMBERS

[76] Inventors: Karl F. Kiefer, 9001 I-45 South, #530, Conroe, Tex. 77385; John H. Cohen; Gerard T. Pittard, both of 2916 West T.C. Jester, Houston, Tex. 77018

[21] Appl. No.: 09/076,579

[22] Filed: May 12, 1998

[51] Int. Cl.[7] ..... A62C 2/00

[52] U.S. Cl. ..... 169/45; 169/46; 169/49; 169/58; 169/26

[58] Field of Search ..... 169/11, 43, 45–49, 169/54, 56–58, 80–81, 26; 137/1

[56] References Cited

U.S. PATENT DOCUMENTS

| | | | |
|---|---|---|---|
| 2,857,971 | 10/1958 | Ferris | 169/58 |
| 3,878,897 | 4/1975 | Goffart | 169/46 |
| 5,096,679 | 3/1992 | Lake | 169/45 |
| 5,232,053 | 8/1993 | Gillis et al. | 169/58 |
| 5,551,517 | 9/1996 | Arsenault et al. | 169/57 |

FOREIGN PATENT DOCUMENTS

| | | | |
|---|---|---|---|
| 6246016 | 9/1994 | Japan | 169/58 |

*Primary Examiner*—Andres Kashnikow
*Assistant Examiner*—Dinh Q. Nguyen
*Attorney, Agent, or Firm*—Kenneth A. Roddy

[57] ABSTRACT

The present invention is directed toward a method for preventing, suppressing or mitigating explosions in a confined subterranean chamber, access opening, or entryway of an underground structure such as the manhole of sewers, service boxes, and mining tunnels. The method utilizes a flexible bladder filled with an inert gas or explosion suppressing agent, wherein the bladder is maintained in the chamber in an inflated condition and the volume of the inflated bladder occupies greater than 70% of the volume of the chamber to significantly reduce the amount of space in which an explosive fuel/air mixture may otherwise accumulate. The bladder is heat critical to disintegrate at a predetermined temperature and release a volume of the explosion suppressing agent or inert gas relative to the volume of the chamber which is sufficient to alter the ratio of the fuel/air mixture in the chamber to prevent, suppress or mitigate the explosive reaction. The inflated bladder also serves as a compressible plenum or pressure accumulator to retard ultimate pressure buildup such that the pressures caused by a limited explosion are not transferred to the chamber cover and interconnecting ducts of the subterranean enclosure.

20 Claims, 2 Drawing Sheets

FIG. 2
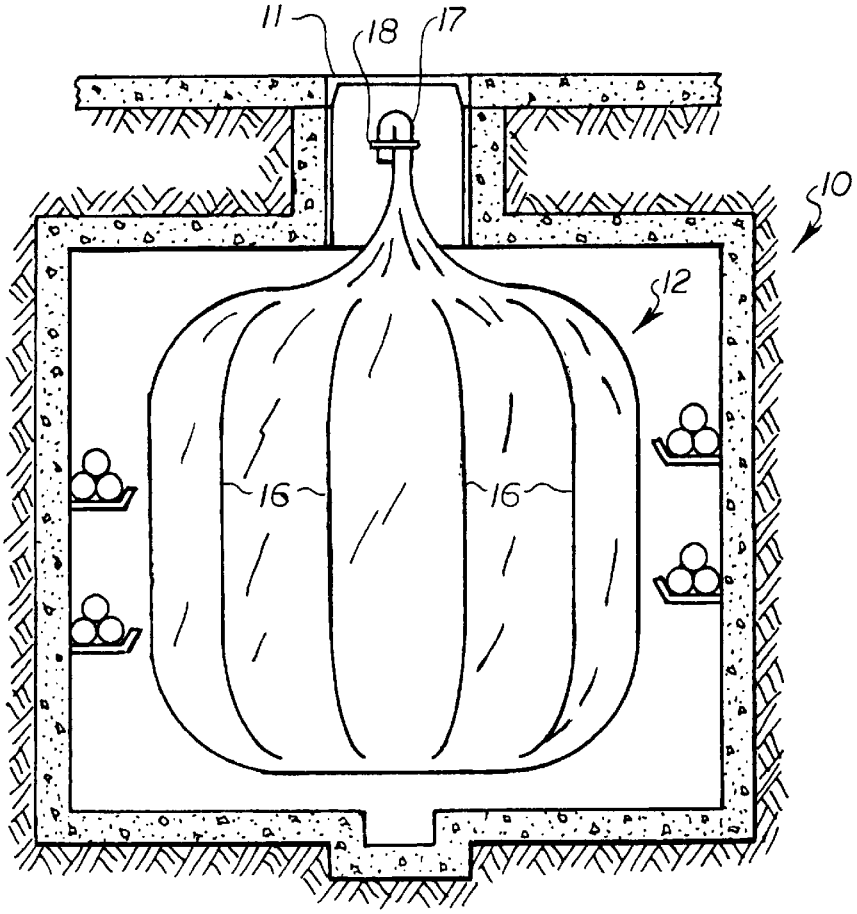
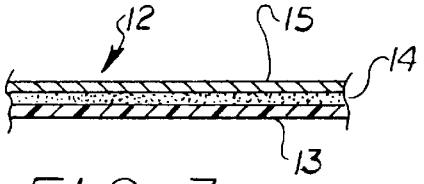
FIG. 3
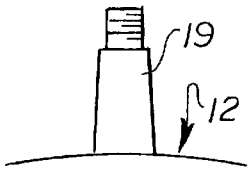
FIG. 4
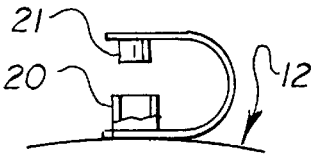
FIG. 5

METHOD AND APPARATUS FOR PREVENTION, SUPPRESSION OR MITIGATION OF EXPLOSIONS IN CONFINED SUBTERRANEAN CHAMBERS

BACKGROUND OF THE INVENTION

1. Field of the Invention

This invention relates generally to methods and apparatus for preventing, suppressing or mitigating explosions in confined subterranean chambers, and more particularly to a method utilizing a flexible heat critical inflated bladder filled with an explosion suppressing agent or inert gas wherein the volume of the inflated bladder displaces the normal atmospheric volume of the chamber in which an explosive fuel/air mixture may otherwise accumulate, and upon failure of the bladder the explosion suppressing agent or inert gas is released to alter the ratio of the fuel/air mixture and suppress or mitigate the explosive reaction. The inflated bladder also serves as a compressible plenum or pressure accumulator to retard ultimate pressure buildup.

2. Brief Description of the Prior Art

Volatile mixtures of gas and air often accumulate in the upper portions, access opening or entryway of a confined subterranean chamber such as the manhole of sewers, service boxes, electrical vaults, mining tunnels, and other confined subterranean enclosures. These chambers sometimes house electrical distribution wiring for utilities and are usually enclosed with a cover and thus provide a protected chamber for the initial ignition of an explosion that is destructive to both human life and property. These explosions have caused multiple fatalities as well as significant property damage.

The vapors and explosive fuel/air mixtures are generally comprised of hydrocarbons in a gaseous state. The actual sources of the fuels are not always known. Further, the accumulation rate and the amount of accumulation has, to date, eluded any predictive process.

Various fuels from various sources can accumulate in confined subterranean spaces. For example, in manholes some common sources include: (1) Gas leaks in distribution gas mains that service individual customers. These leaks propagate through the soil to an area of less pressure. Manholes offer this area of lower pressure because they are exposed to ambient atmospheric conditions, in contrast to the higher pressures in the soil that are the result of the weight of the soil plus the weight of any water in the soil. (2) Accumulations of methane produced by bacterial and decaying biological material. (3) Spills of gasoline and oil from street traffic as well as other volatile wastes that are washed into manholes via normal precipitation runoff. (4) Super-heating or cooking of polymer insulation of the distribution wires that are in the manholes. This super-heating or cooking process causes the hydrocarbons in the insulation to return to the gaseous volatile components from which they were made, and is most often caused by high resistance flaws in the cable that go into thermal runaway and result in low voltage arcing.

Gaseous fuels become explosive when mixed with an appropriate amount of air. The size of the explosion (notwithstanding the effects of the stoichiometric relations of fuel-to-air) will be largely determined by the volume of the fuel and air mixture within a confined space. The larger the volume of the fuel and air mixture, the larger (and more potentially destructive) the resulting explosive event.

The optimum ratio for a fuel/air mixture to cause an explosion is approximately 9 or 10 parts air to 1 part fuel.

Although this ratio varies with any particular hydrocarbon gas, the 9:1 or 10:1 mixture will usually produce an explosive event when common hydrocarbon gases such as methane, ethylene, acetylene, etc., are involved. This fuel/air ratio must be obtained and maintained if the fuel is to explode with maximum effect. If a rich mixture (too little air) or a lean mixture (too much air) is present, the resulting explosion will release less energy than would have been released if the explosion was the result of an optimum mixture. Further, if the ratio of fuel-to-air never reaches explosive potential, a rapid release of energy (explosion) will not take place. Thus, any action that will prevent or reduce the accumulation of a potentially explosive gas and air mixture will suppress, mitigate, or even possibly prevent an explosion.

Several methods have been proposed to contain or reduce the effects of explosive-like reactions resulting from fuel-air mixtures. The following patents are representative of the prior art attempts.

Geertz, U.S. Pat. No. 2,352,378 discloses the formation of a flame barrier in a mine by spraying into the mine passageway a combination of a carbon dioxide "snow" and rock dust.

Glendinning et al, U.S. Pat. No. 2,693,240 detects an incipient explosion reaction by detecting a rate of static pressure increase above a predetermined level.

Mathisen, U.S. Pat. No. 2,869,647 discloses an apparatus for detecting and suppressing explosions, in which there is a radiation detector responding to certain frequencies of radiation, and a liquid suppressant distributor having electrically ignitable explosive means for projecting the liquid.

Kopan et al, U.S. Pat. No. 3,156,908, discloses particular circuitry for detecting a flame.

Mitchell et al, U.S. Pat. No. 3,482,637 and Jamison, U.S. Pat. No. 3,515,217 disclose exploding fire suppressing material (e.g. alkali metal carbonates) as a means of suppressing a gas-air explosion.

One of the problems of the systems taught by the above listed patents is that they are susceptible to frequent reactions to false alarms because of their inability to discriminate between what is an actual condition of a possibly rapidly propagating combustion reaction of an air-fuel mixture and other disturbances that do not result in such a combustion reaction, such as a stationary flame, an electric spark, or a blast wave (resulting, for example, from an explosion deliberately initiated). Another problem with these types of systems is that of deploying a combustion suppressing material so that it provides an effective barrier to the propagating reaction. Since the actual reaction front is usually preceded by a pressure wave, there is a tendency for the suppressing agent to be blown away from the reaction front so as to diminish is suppressing action.

Richmond, U.S. Pat. No. 3,831,318 discloses an explosion detection and suppression system wherein a plurality of bags are stored in a deflated condition around the side walls of a coal mine passageway and connected with a radiation sensor, a static pressure sensor, a dynamic pressure sensor, and a data analysis computer connected with an activating means. The bags are inflated with a combustion suppressing agent upon the occurance of a predetermined rate of change in one of the sensed conditions to form a barrier in the passageway. The bags are made of a heat deteriorable material so that the heat from the combustion reaction causes the combustion suppressing agent in the bags to become exposed to the combustion reaction.

Jenkins, U.S. Pat. No. 3,990,464 discloses a heat responsive duct closing method and apparatus wherein a normally collapsed leak-proof inflatable bag is stored in the ventilating ducts of a building and automatically inflates upon activation of a smoke detector to completely seal the duct from the passage of air and smoke to block the spread of noxious smoke and fumes and prevent the access of fresh air which would contribute to the spread of a fire.

Clodfelter et al, U.S. Pat. No. 5,501,284 discloses an inflatable bag fire extinguishing system for use in ventilated or confined spaces, such as an aircraft engine compartment, wherein a porous bag is stored in a deflated condition in a confined compartment having ventilating air flowing therethrough and connected with a container containing a charge of gaseous vaporizable liquid fire extinguishing agent through an electrically operated release valve or rupture diaphragm. Upon detection of a fire, the bag is inflated with the fire extinguishing agent to block incoming ventilation air which is needed to sustain the fire, to displace a portion of residual air in the compartment, and simultaneously disperse the fire extinguishing agent into the remaining voids of the compartment through the pores of the bag. The bag may also be made with a non-porous wall portion on the upstream side.

The Jenkins, Clodfelter et al, and Richmond patents all teach inflating a collapsed bag upon detection of a potential explosion or fire or upon the occurance of a such an event to block either the spread of smoke or the propagation of the explosion while simultaneously dispersing explosion suppression or fire extinguishing agents. They do not teach (1) maintaining a bag or bladder inflated at all times to reduce the volume and displace the normal atmospheric content in the chamber and thereby reduce the amount of space in which the explosive fuel/air mixture may otherwise accumulate. Although these patents teach filling a bag or bladder with explosion suppressing and fire extinguishing agents, they do not teach (2) that the bag or bladder is heat critical at a predetermined temperature and contains a predetermined volume of inert gas relative to the volume of the chamber which is sufficient to alter the ratio of the fuel/air mixture in the chamber when the bladder fails to suppress or mitigate the explosive reaction. These patents also do not teach (3) utilizing the bag or bladder as a compressible plenum or accumulator to retard ultimate pressure buildup such that the pressures caused by a limited explosion are not transferred to the chamber cover and interconnecting ducts of the subterranean enclosure.

The present invention is distinguished over the prior art in general, and these patents in particular by a method for preventing, suppressing or mitigating explosions in a confined subterranean chamber, access opening, or entryway of an underground structure such as the manhole of sewers, service boxes, and mining tunnels. The method utilizes a flexible bladder filled with an inert gas or explosion suppressing agent, wherein the bladder is maintained in the chamber in an inflated condition and the volume of the inflated bladder occupies greater than 70% of the volume of the chamber to significantly reduce the amount of space in which an explosive fuel/air mixture may otherwise accumulate. The bladder is heat critical to disintegrate at a predetermined temperature and release a volume of the explosion suppressing agent or inert gas relative to the volume of the chamber which is sufficient to alter the ratio of the fuel/air mixture in the chamber to prevent, suppress or mitigate the explosive reaction. The inflated bladder also serves as a compressible plenum or pressure accumulator to retard ultimate pressure buildup such that the pressures caused by a limited explosion are not transferred to the chamber cover and interconnecting ducts of the subterranean enclosure.

SUMMARY OF THE INVENTION

It is therefore an object of the present invention to provide a method and apparatus for preventing, suppressing or mitigating an explosion in a confined subterranean chamber by reducing the volume and displacing the normal atmospheric content in the chamber and thereby reduce the amount of space in which the explosive fuel/air mixture may otherwise accumulate.

It is another object of this invention to provide a method and apparatus for preventing, suppressing or mitigating an explosion in a confined subterranean chamber by utilizing a flexible inflated bladder that is maintained in the chamber in an inflated condition and the volume of the inflated bladder occupies greater than 70% of the volume of the chamber to significantly reduce the amount of space in which an explosive fuel/air mixture may otherwise accumulate.

Another object of this invention is to provide a method and apparatus for preventing, suppressing or mitigating an explosion in a confined subterranean chamber by utilizing a flexible inflated bladder that is heat critical at a predetermined temperature and contains a predetermined volume of inert gas relative to the volume of the chamber which is sufficient to alter the ratio of the fuel/air mixture in the chamber when the bladder fails to prevent, suppress or mitigate the explosive reaction.

Another object of this invention is to provide a method and apparatus for preventing, suppressing or mitigating an explosion in a confined subterranean chamber by altering the ratio of the fuel/air mixture in the chamber upon at a predetermined critical temperature to a level where a potential explosion is either prevented, or if an explosion occurs, the destructive effects or injury to persons or property is significantly reduced.

Another object of this invention is to provide a method and apparatus for preventing, suppressing or mitigating an explosion in a confined subterranean chamber by utilizing a flexible inflated bladder that functions as a compressible plenum or accumulator to retard ultimate pressure buildup in the chamber such that the pressures caused by a limited explosion are not transferred to the chamber cover and interconnecting ducts of the chamber.

A further object of this invention is to provide a method for automatically preventing, suppressing or mitigating an explosion in a confined subterranean chamber which does not require human intervention or expensive detection, monotoring, and activating mechanisms.

A still further object of this invention is to provide a method for automatically preventing, suppressing or mitigating an explosion in a confined subterranean chamber which is inexpensive to implement, and reliable in operation.

Other objects of the invention will become apparent from time to time throughout the specification and claims as hereinafter related.

The above noted objects and other objects of the invention are accomplished by a method for preventing, suppressing or mitigating explosions in a confined subterranean chamber, access opening, or entryway of an underground structure such as the manhole of sewers, service boxes, and mining tunnels. The method utilizes a flexible bladder filled with an inert gas or explosion suppressing agent, wherein the bladder is maintained in the chamber in an inflated condition and the volume of the inflated bladder occupies greater than 70% of the volume of the chamber to significantly reduce the amount of space in which an explosive fuel/air mixture may otherwise accumulate. The bladder is heat critical to disintegrate at a predetermined temperature and release a volume of the explosion suppressing agent or inert gas relative to the volume of the chamber which is sufficient to alter the ratio of the fuel/air mixture in the chamber to prevent, suppress or mitigate the explosive reaction. The inflated bladder also serves as a compressible plenum or pressure accumulator to retard ultimate pressure buildup such that the pressures caused by a limited explosion are not transferred to the chamber cover and interconnecting ducts of the subterranean enclosure.

BRIEF DESCRIPTION OF THE DRAWINGS

FIG. 2 is a cross section through the subterranean chamber, with its cover replaced and the flexible bladder in the installed inflated condition.

FIG. 3 is a partial cross section through a section of the wall of the flexible bladder.

FIG. 4 is a partial elevation of a section of the flexible bladder showing a Schrader valve for filling the bladder.

FIG. 5 is a partial elevation of a section of the flexible bladder showing a tubular inflation port with a seal plug.

DESCRIPTION OF THE PREFERRED EMBODIMENT

Figure 1:
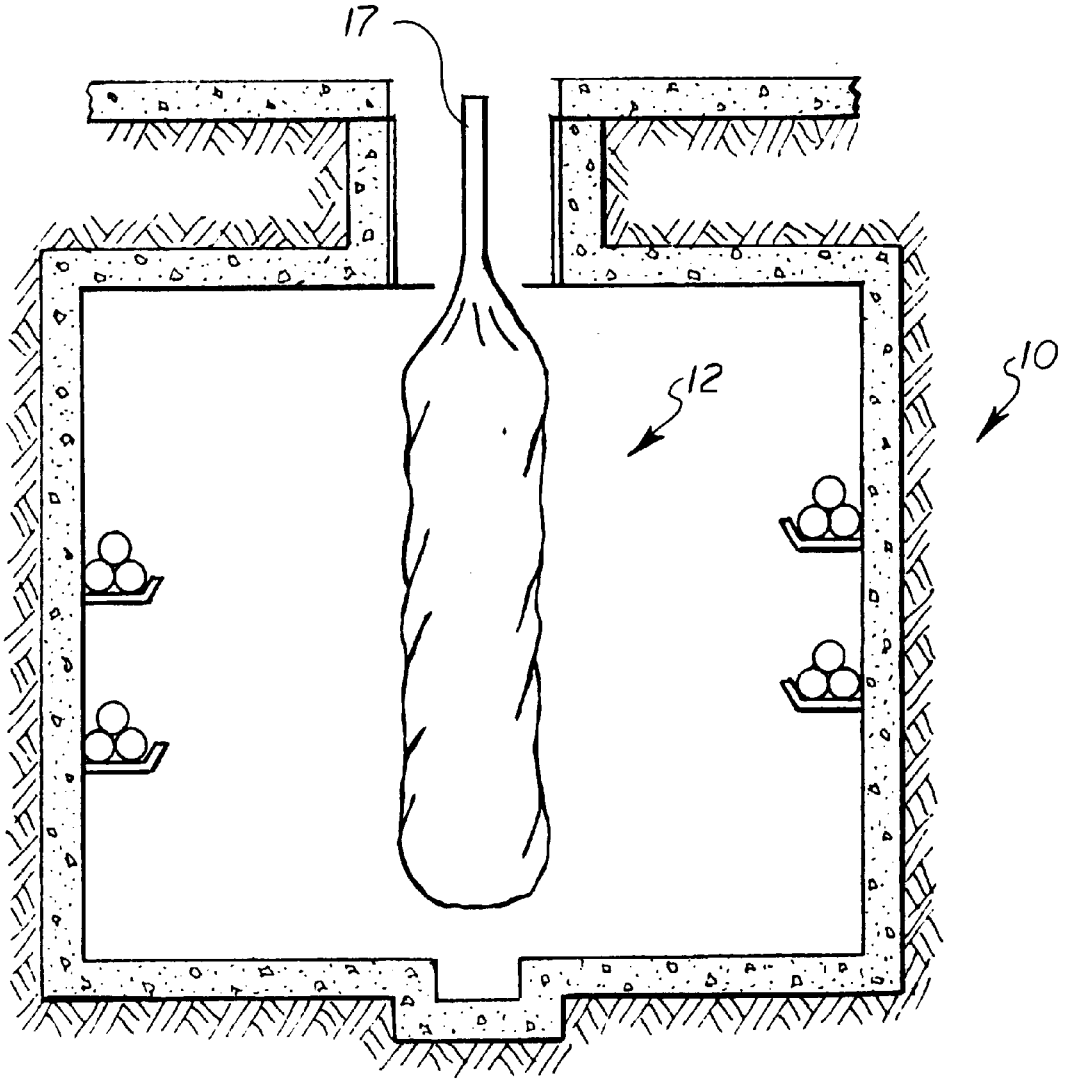
FIG. 1 is a cross section showing somewhat schematically a typical subterranean chamber, with its cover removed and a flexible bladder in accordance with the present invention being installed therein in the deflated condition.

Referring now to the drawings by numerals of reference, there is shown somewhat schematically in FIG. 1, a typical subterranean chamber 10, with its cover removed and a flexible bladder 12 in accordance with the present invention being installed therein in the deflated condition. FIG. 2 shows the flexible bladder 12 installed in the subterranean chamber 10 in the normally inflated condition with the chamber cover 11 replaced to enclose the chamber.

It should be understood that the illustrated chamber 10 is representative of a typical confined chamber, such as a manhole, access opening or entryway of an underground structure, such as the manhole of sewers, service boxes, and mining tunnels. Typically, these types of chambers are enclosed with a cover and some may house electrical distribution wiring for utilities and thus they provide a confined space in which an explosive fuel/air mixture may accumulate and in which the initial ignition of a destructive explosion may take place.

The bladder 12 is a flexible inflatable envelope formed of a substantially gas impervious material such as polyester (Mylar) or polyurethane, and may be coated with other polymers and co-polymers and metallic films to increase resistance to permeability and puncture. Preferably, the total wall thickness of the bladder is in the range of from about 0.5 mils to about 0.3 mils. As shown in FIG. 3, in a preferred embodiment, the bladder is formed of a nylon or dacron material 13 covered with a thin polyethylene intermediate layer 14 and a metallic outer layer 15. The thickness of the individual layers may vary to facilitate permeability, tear resistance, and failure upon exposure to a predetemined temperature. The metallic film and coatings also increase resistance of the bladder to puncture or destruction by rodents that may inhabit the manhole or other subterranean enclosure.

The materials that make up the bladder 12 are heat critical and are designed to disintegrate at about 220° F. so that they will disintegrate when exposed to the flame front of an explosion.

The bladder material has little or no resilience or memory capability. In other words, it does not require stretching to inflate the device to the proper volume. This feature allows the bladder 12 to be maintained at the proper inflated shape with a minimum of internal pressure. The lower the internal pressure, the lower the permeability rate of the interior gas. The bladder 12 may be designed to assume various shapes to conform to the interior of the chamber in which it is to be installed when it is inflated. For example, it may take on a generally cylindrical, generally spherical, or a generally polygonal or polyhedron configuration in its inflated condition.

As shown in FIG. 2, flexible ribs or "stays" 16 may also be secured to the interior or exterior wall of the bladder 12 to maintain the inflated shape of the bladder with a minimum of internal pressure. The ribs or stays 16 are elongate stiff rods which form circumferentially spaced longitudinal members when the bladder 12 is inflated, similar to the lines of longitude on the surface of a globe. With the bladder 12 in a deflated condition, these ribs or stays are gathered together in a column and the flexible material of the bladder is wrapped or twisted therearound to minimize its size, in the fashion of wraping an umbrella. After the wrapping or twisting action, the now columnar shape can be further bent into a circle and secured to further minimize the deflated size for ease in packing, storage and transportation.

The bladder 12 is provided with a conventional fluid inlet and seal means which is illustrated by way of example in FIGS. 1 and 2, as a tubular reduced neck portion 17 at its upper end. As shown in FIG. 2, the reduced neck portion 17 may be folded over on itself and secured with a rubber band 18 after the bladder 12 has been inflated to seal the bladder. The fluid inlet and seal means may also be in the form of a conventional Schrader valve 19 (FIG. 4) which automatically seals after inflation, or may be in the form of a circular or tubular fluid inlet port 20 that is sealed with a removable plug 21 manually engaged in the inlet port after inflation (FIG. 5).

The bladder 12 is sized and shaped relative to the chamber 10 in which it is to be installed such that in its inflated condition, it will occupy from about 75% to about 100% of the volume of the chamber in which it is installed, and preferably will occupy about 95% or more of the the free space in the chamber. Thus, in a typical installation only about 5% to about 25% of the chamber volume is available for the accumulation of fuel/air mixtures. Since most destructive explosive events require at least 30% of the volume of the confined space in order to collect sufficient fuel for a destructive explosion, the bladder displacement of the chamber volume precludes a severe explosion by preventing the accumulation of a sufficient fuel/air mixture. It is estimated that an explosion in a typical manhole resulting from a worst-case fuel/air mixture that is only 10% of the manhole volume would not even displace the manhole cover.

The bladder 12 is inflated by filling its interior with a suitable explosion suppressing agent or inert gas such as nitrogen. If an explosive fuel/air mixture accumulates in the void spaces left unoccupied by the bladder volume, the flame front of the explosion would immediately disintegrate the thin bladder skin and present nothing but an inert gas (nitrogen) atmosphere to the explosive mixture. Since nitrogen is completely stable and will not support combustion, the optimum explosive ratio of fuel-to-air will be disrupted resulting in the immediate suppression or mitigation of the explosion.

Should an explosion occur in a pipe main, duct, or tunnel adjoining the chamber or manhole, or in the void spaces left unoccupied by the bladder volume, the volume of the inflated bladder serves as an effective plenum that must be compressed by the limited explosive event before pressures can be transferred to the cover of the chamber or manhole or interconnecting ducts. This volume acts as a limited pressure accumulator to retard the ultimate pressure buildup thus reducing the impact potential of the explosion.

Having described the bladder apparatus and the environment in which it is used, the method for suppressing or mitigating explosions utilizing the bladder apparatus will be described with reference to FIGS. 1 and 2.

The volume of the chamber 10 in which the bladder 12 is to be installed is determined. A bladder sized and shaped to occupy greater than about 70%, preferably from about 75% to about 100% of the volume of the chamber, is selected.

Prior to lifting the lid or cover 11 of the chamber 10 and during installation of the bladder 12, the installation crew carries out proper gas detection and venting procedures of the atmosphere in the chamber in accordance with local and OSHA "Confined Space Entry" regulations.

The bladder 12 in a deflated condition is lowered into the chamber 10 (FIG. 1). The bladder 12 is then inflated by filling its interior with a suitable explosion suppressing agent or inert gas such as nitrogen to the desired pressure, such that the volume of the bladder occupies from about 75% to about 100% of the volume of the chamber. The bladder is then sealed to contain the explosion suppressing agent or inert gas (FIG. 2) and the chamber cover 11 is replaced.

Since the bladder material has little or no resilience or memory capability, it does not require stretching to inflate the device to the proper volume, and the bladder is inflated and maintained at the proper inflated shape with a minimum of internal pressure. The permeability rate of the interior explosion suppressing agent or inert gas is thus significantly reduced due to the lower internal pressure.

Once inflated in position in the chamber or manhole it remains there until a distribution fault requires access to the chamber or manhole or until it is inspected as a part of routine inspection procedures. While in position in the chamber or manhole, it performs three critical functions that serve to reduce explosive potential and prevent or mitigate explosions.

First, the bladder remains inflated at all times to reduce the volume and displace the normal atmospheric content in the chamber and thereby dramatically reduces the amount of free space in which the explosive fuel/air mixture may otherwise accumulate. For example, a bladder which occupies from 75% to 95% of the free space in the chamber will leave only 5% to 25% of the chamber volume available for the accumulation of fuel/air mixtures. Since destructive explosive events require at least 30% of the volume of the confined space in order to collect sufficient fuel for a destructive explosion, the displacement of the chamber volume precludes a severe explosion by preventing the accumulation of a sufficient fuel/air mixture.

Second, the materials that make up the bladder are heat critical and are designed to disintegrate at about 220° F. and the internal volume of the bladder is filed with an explosion suppressing agent or inert gas, such as nitrogen. If an explosive mixture accumulates in the void spaces left unoccupied by the bladder volume, the flame front of the explosion would immediately disintegrate the thin bladder skin and present nothing but an explosion suppressing agent or inert gas (nitrogen) atmosphere to the explosive mixture, thereby disrupting the optimum explosive ratio of fuel-to-air and resulting in the immediate prevention, suppression or mitigation of the explosion.

Third, should an explosion occur in a pipe main, duct, or tunnel adjoining the chamber or manhole, or in the void spaces left unoccupied by the bladder volume, the volume of the inflated bladder serves as an effective plenum that must be compressed by the limited explosive event before pressures can be transferred to the cover of the chamber or manhole or interconnecting ducts. This volume acts as a limited pressure accumulator to retard the ultimate pressure buildup thus reducing the impact potential of the explosion.

While this invention has been described fully and completely with special emphasis upon a preferred embodiment, it should be understood that within the scope of the appended claims the invention may be practiced otherwise than as specifically described herein.

For example, multiple bladders may be used to fit in the confined space and the bladder may be provided with frangible rupture points. The bladder may also be filled with air to provide considerable volume displacement effect.

We claim:

1. A method for preventing, suppressing or mitigating explosions in a subterranean chamber in which a potentially explosive fuel/air mixture may accumulate, comprising the steps of:

determining the volume of the upright subterranean chamber;

providing a flexible inflatable bladder formed of substantially gas impermeable material sized and shaped to occupy greater than 70% of the volume of said chamber in an inflated condition, said material being heat critical to disintegrate at a given temperature;

inserting said bladder in a deflated condition into said chamber;

inflating said bladder with an explosion suppressing agent such that said inflated bladder occupies greater than 70% of the volume of said chamber to substantially reduce the chamber volume in which an explosive fuel/air mixture may otherwise accumulate;

sealing said bladder to contain said explosion suppressing agent;

said bladder in the inflated condition remaining in said chamber to serve as a compressible plenum to absorb sudden excessive pressures in said chamber, and said bladder disintegrating upon exposure to a flame front of an explosion of said given temperature to release said explosion suppressing agent and thereby alter the ratio of the fuel/air mixture in said chamber sufficient to prevent, suppress or mitigate the explosive reaction.

2. The method according to claim 1, wherein said step of inflating said bladder with an explosion suppressing agent comprises inflating said bladder to occupy from about 75% to about 100% of the volume of said chamber.

3. The method according to claim 1, wherein said step of inflating said bladder with an explosion suppressing agent comprises inflating said bladder with an inert gas.

4. The method according to claim 1, wherein said step of inflating said bladder with an explosion suppressing agent comprises inflating said bladder with nitrogen gas.

5. A flexible inflatable bladder for installation in a subterranean chamber of a given volume in which a potentially explosive fuel/air mixture may accumulate to prevent, suppress or mitigate explosions in the chamber, comprising:

a flexible inflatable bladder formed of substantially gas impermeable material sized and shaped to occupy greater than 70% of the volume of said chamber in an inflated condition, said material being heat critical to disintegrate at a given temperature;

said bladder being filled and inflated with an explosion suppressing agent to occupy greater than 70% of the volume of said chamber so as to substantially reduce the chamber volume in which an explosive fuel/air mixture may otherwise accumulate;

said inflated bladder being maintained in said inflated condition in said chamber to serve as a compressible plenum to absorb sudden excessive pressures in said chamber, and said bladder disintegrating upon exposure to a flame front of an explosion of said given temperature to release said explosion suppressing agent and thereby alter the ratio of the fuel/air mixture in said chamber sufficient to prevent, suppress or mitigate the explosive reaction.

6. The bladder according to claim 5, wherein said bladder is filled and inflated with said explosion suppressing agent to occupy from about 75% to about 100% of the volume of said chamber.

7. The bladder according to claim 5, wherein said explosion suppressing agent comprises an inert gas.

8. The bladder according to claim 5, wherein said explosion suppressing agent comprises nitrogen gas.

9. The bladder according to claim 5, wherein said bladder has a wall thickness in the range of from about 0.5 mils to about 0.3 mils.

10. The bladder according to claim 5, wherein said substantially gas impermeable material is heat critical to disintegrate at a temperature of approximately 220° F.

11. The bladder according to claim 5, wherein said substantially gas impermeable material comprises a material selected from the group consisting of polyester, polyurethane, Mylar, nylon, and dacron.

12. The bladder according to claim 11, wherein said substantially gas impermeable material is coated with a coating selected from the group consisting of polymers and co-polymers and metallic films to increase resistance to gas permeability and puncture.

13. The bladder according to claim 5, wherein said substantially gas impermeable material comprises a sandwich construction having a first layer of material selected from the group consisting of polyester, polyurethane, Mylar, nylon, and dacron;

a second layer of material selected from the group consisting of polymers and co-polymers; and a third layer of metallic material.

14. The bladder according to claim 5, further comprising a plurality of stiff flexible stays secured to the surface of said bladder to maintain the shape of said bladder in an inflated configuration.

15. The combination of a subterranean chamber having a given volume in which a potentially explosive fuel/air mixture may accumulate and a flexible inflatable bladder installed therein to prevent, suppress or mitigate explosions in the chamber;

said flexible inflatable bladder formed of substantially gas impermeable material sized and shaped to occupy greater than 70% of the volume of said chamber in an inflated condition, said material being heat critical to disintegrate at a given temperature;

said bladder being filled and inflated with an explosion suppressing agent to occupy greater than 70% of the volume of said chamber so as to substantially reduce the chamber volume in which an explosive fuel/air mixture may otherwise accumulate;

said inflated bladder being maintained in said inflated condition in said chamber to serve as a compressible plenum to absorb sudden excessive pressures in said chamber, and said bladder disintegrating upon exposure to a flame front of an explosion of said given temperature to release said explosion suppressing agent and thereby alter the ratio of the fuel/air mixture in said chamber sufficient to prevent, suppress or mitigate the explosive reaction.

16. The combination according to claim 15, wherein said bladder is filled and inflated with said explosion suppressing agent to occupy from about 75% to about 100% of the volume of said chamber.

17. The combination according to claim 15, wherein said explosion suppressing agent comprises an inert gas.

18. The combination according to claim 15, wherein said explosion suppressing agent comprises nitrogen gas.

19. The combination according to claim 15, wherein said bladder has a wall thickness in the range of from about 0.3 mils to about 0.5 mils.

20. The combination according to claim 15, wherein said substantially gas impermeable material is heat critical to disintegrate at a temperature of approximately 220° F.

* * * * *